US006231375B1

(12) United States Patent
Kashiyama

(10) Patent No.: US 6,231,375 B1
(45) **Date of Patent: *May 15, 2001**

(54) WIRE HOLDING STRUCTURE FOR CONNECTOR HOUSING

(75) Inventor: Motohisa Kashiyama, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,806

(22) Filed: Jan. 29, 1999

(30) Foreign Application Priority Data

Jan. 30, 1998 (JP) ..... P10-019545

(51) Int. Cl.[7] ..... H01R 13/58
(52) U.S. Cl. ..... 439/456
(58) Field of Search ..... 439/453, 447, 439/456, 374, 436, 369; 174/136, 135, 72 A, 84

(56) References Cited

U.S. PATENT DOCUMENTS

| | | | | |
|---|---|---|---|---|
| 3,165,574 | * | 1/1965 | Carling | 174/59 |
| 3,428,742 | * | 2/1969 | Smith | 174/136 |
| 4,282,398 | * | 8/1981 | Solomon | 174/136 |
| 4,500,149 | * | 2/1985 | Mackay | 439/834 |
| 4,653,825 | * | 3/1987 | Olsson | 439/447 |
| 4,869,686 | * | 9/1989 | Michaels et al. | 439/457 |
| 4,970,351 | * | 11/1990 | Kirlin | 174/136 |
| 5,022,874 | * | 6/1991 | Lostumo | 439/736 |
| 5,168,128 | * | 12/1992 | Thomsen | 439/447 |
| 5,264,663 | * | 11/1993 | Noguchi et al. | 439/465 |
| 5,848,916 | * | 12/1998 | Huang | 439/457 |

FOREIGN PATENT DOCUMENTS

| | | |
|---|---|---|
| 2-98473 | 6/1990 | (JP) . |
| 2-227973 | 11/1990 | (JP) . |

* cited by examiner

*Primary Examiner*—Renee Luebke
*Assistant Examiner*—Briggitte R. Hammond
(74) *Attorney, Agent, or Firm*—Morgan, Lewis & Bockius LLP

(57) ABSTRACT

A wire holding structure for a connector housing comprises an electric wire one end of which is connected to a connection terminal accommodated within the connector housing, and lead out from a rear end portion of the connector housing, a wire holding portion extending from the connector housing along in a direction of which the electric wire is lead out, a groove portion formed on the wire holding portion along extending direction thereof and having a substantially U-shaped cross-section, and a protection tube fitted into the groove portion in a state of which the electric wire is inserted therethrough.

11 Claims, 8 Drawing Sheets

WIRE HOLDING STRUCTURE FOR CONNECTOR HOUSING

BACKGROUND OF THE INVENTION

The present invention relates to a wire holding structure for a connector housing, and more particularly to a wire holding structure for a connector housing having a wire holding member provided in the housing so as to cover and protect electric wires having one ends connected to a connecting terminal accommodated in the housing.

Among connector housings for connectors for connecting electric wires, there are connector housings which are provided with various wire holding member so as to restrict the direction in which electric wires having one ends connected to a connecting terminal accommodated in the housing are led out, and to protect the wires by covering them with a protective member or the like.

For example, in a connector housing 1 disclosed in Japanese Utility Model Publication No. Hei 2-98473, an unillustrated connecting terminal connected to one ends of electric wires 2 is accommodated in a housing body 3, as shown in FIG. 9. Further, a retaining member 4 for preventing the connecting terminal from coming off in the rearward direction is provided on the housing body 3, and the retaining member 4 has an arm portion 5 for hooking the wires 2 at a predetermined position on the connector housing 1. When the retaining member 4 is attached to the housing body 3, by merely passing the wires 2 on the inner side of the arm 5, it is possible to prevent the entanglement or the like of the wires 2 during transport and storage, and alleviate a tensile force applied to the wires 2 during use.

However, the above-described connector housing 1 able to restrict the leading-out direction of the wires 2 to some extent by the arm 5 which is the wire holding member, but since a member for covering and protecting the wires 2 is not provided, there is a possibility of causing damage to the wires 2 during transport or use.

Accordingly, there is a type in which, as in the case of a connector housing 6 shown in FIG. 10, a protective cap 8, which is designed to protect the wires 2 having one ends connected to an unillustrated connecting terminal accommodated in a housing body 7 and the other ends led out from a rear end portion of the housing body 7 and to restrict the leading-out direction of the wires 2, is attached to the housing body 7 as the wire holding member.

Meanwhile, in a case where the wires 2 are inserted in a vinyl tube 9, i.e., a hollow cylindrical protective tube, for protecting the wires 2 led out from the connector housing 6 from the tensile force or heat during use, a plate-like holding portion 8*a* is provided at a wire-leading-out-direction end portion of the protective cap 8, and a adhesive tape T or the like is wound the plate-like holding portion 8*a* together with the vinyl tube 9 extending along the plate-like holding portion 8*a*, thereby fixing the vinyl tube 9 to the connector housing 6.

In addition, in electric connectors disclosed in Unexamined Japanese Patent Publication No. Hei 2-227973, a pair of split-type covers serving as a protective cover have a retaining portion for engaging a neck portion of a connector housing and has a corrugated tube holding groove, and the neck portion of the housing and an end portion of the corrugated tube are nipped and fixed by the split-type covers, thereby protecting joint portions of a cable and the housing.

Accordingly, the cable having one end connected to an unillustrated connecting terminal accommodated in the housing is protected by the split-type covers serving as the wire holding member, and the direction in which the cable is led out is restricted by the split-type covers. In addition, the corrugated tube serving as the protective tube is fixed to the connector housing as the end portion of the corrugated tube is nipped and fixed in the corrugated-tube holding groove in the split-type covers.

However, in the case of the connector housing 6 shown in FIG. 10, the vinyl tube 9 together with the wires 2 must be wound onto the plate-like holding portion 8*a* of the protective cap 8 by the adhesive tape T or the like, so that there is a problem in that the operating efficiency in assembling is not good. In particular, in a case where the direction in which the wires 2 are led out is restricted in such a manner as to be oriented toward the front end side of the housing body 7, since the plate-like holding portion 8*a* extends in such a manner as to be laid along and in close proximity to the side surface of the housing body 7, the gap between the housing body 7 and the vinyl tube 9 becomes narrow, so that the operation of winding the adhesive tape T becomes difficult.

In addition, in the case of the electric connectors disclosed in Unexamined Japanese Patent Publication No. Hei 2-227973, the operation of fixing the corrugated tube to the connector housing is relatively easy by the use of the split-type covers such as those described above, but the retaining portion and the corrugated-tube holding groove must be formed in the split-type covers. Further, in the case where the end portion of the corrugated tube is nipped and fixed by the split-type covers, since the presence or absence of an allowance for holding (nipping state) by the corrugated-tube holding groove becomes important, so that there arises the need to provide a window allowing the nipping state to be viewed so as to ensure reliable fixation. Accordingly, there has been a problem in that the shape of the split-type covers becomes complex, resulting in a rise in the manufacturing cost.

SUMMARY OF THE INVENTION

It is therefore an object of the present invention is to provide an inexpensive wire holding structure for a connector housing which makes it possible to reliably protect the electric wires led out from the connector housing by a simple attaching operation.

In order to achieve the above object, there is provided a wire holding structure for a connector housing comprising: an electric wire one end of which is connected to a connection terminal accommodated within the connector housing, and led out from a rear end portion of the connector housing; a wire holding portion extending from the connector housing along in a direction of which the electric wire is led out; a groove portion formed on the wire holding portion along extending direction thereof and having a substantially U-shaped cross-section; and a protection tube fitted into the groove portion in a state of which the electric wire is inserted therethrough.

Accordingly, since the wires are held by the wire holding portion through the protective tube press fitted and held in the wire holding portion, it is sufficient to merely press fit the protective tube into the groove portion of the wire holding portion, and there is no need to hold the wires by the troublesome tape winding.

In addition, the wire holding portion of the wire holding member constituted by the wire holding portion and the protection tube suffices if it is provided with the groove portion extending along the led-out direction of the wires, so that its shape does not become complex.

The wire holding structure may further comprise a rear cover detachably provided on the rear portion of the connector housing for protecting the led-out electric wire, wherein the wire holding portion is integrally provided with the rear cover.

The wire holding structure may further comprise a rear holder detachably provided on the rear portion of the connector housing for preventing the terminal from removing from the connector housing, wherein the wire holding portion is integrally provided with the rear holder.

At least one of the wire holding portion and the protection tube may be formed so as to be able to deform elastically.

When the wire holding portion is made of a hard material and the protection tube is made of a soft material, a width of the groove portion may be substantially equal to a diameter of the protection tube.

In this case, edge portions of the groove portion may be tapered. Projections may be formed on edge portions of the groove portion.

Alternatively, a width of the groove portion may be less than a diameter of the protection tube.

When the protection tube is made of a hard material and the wire holding portion is made of a soft material, a slit may be formed on the protection tube along a longitudinal direction thereof.

The groove portion may be formed in such a sectional shape as to cover an outer periphery of the protective tube circumferentially over an angular range of more than 180° and less than 300°.

DETAILED DESCRIPTION OF THE PREFERRED EMBODIMENTS

Referring now to the accompanying drawings, a detailed description will be given of a wire holding structure for a connector housing according to one embodiment of the present invention.

Figure 1:
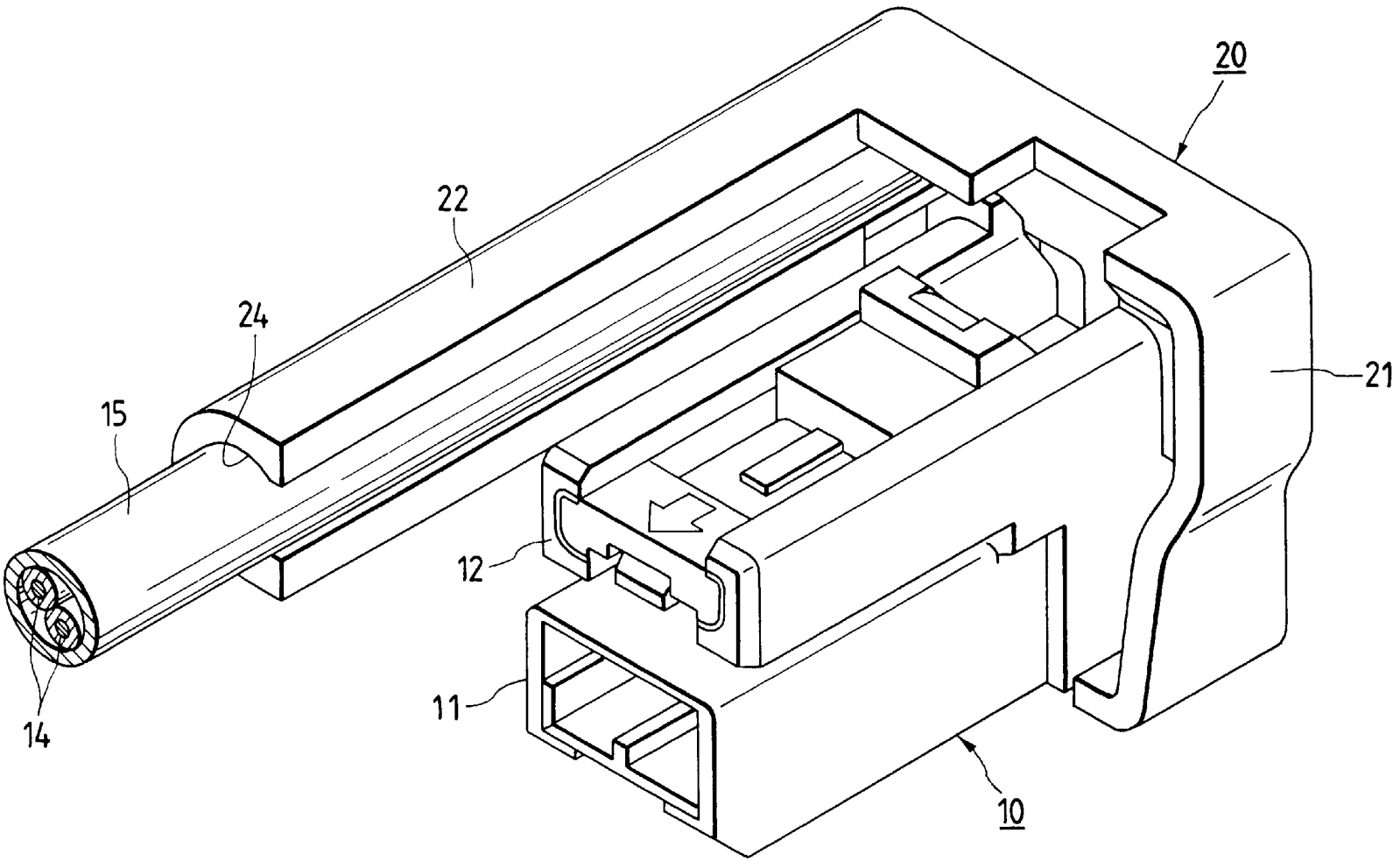
FIG. 1 is an overall perspective view of a connector housing in which a wire holding structure for a connector housing according to one embodiment of the present invention is adopted.
Figure 2:
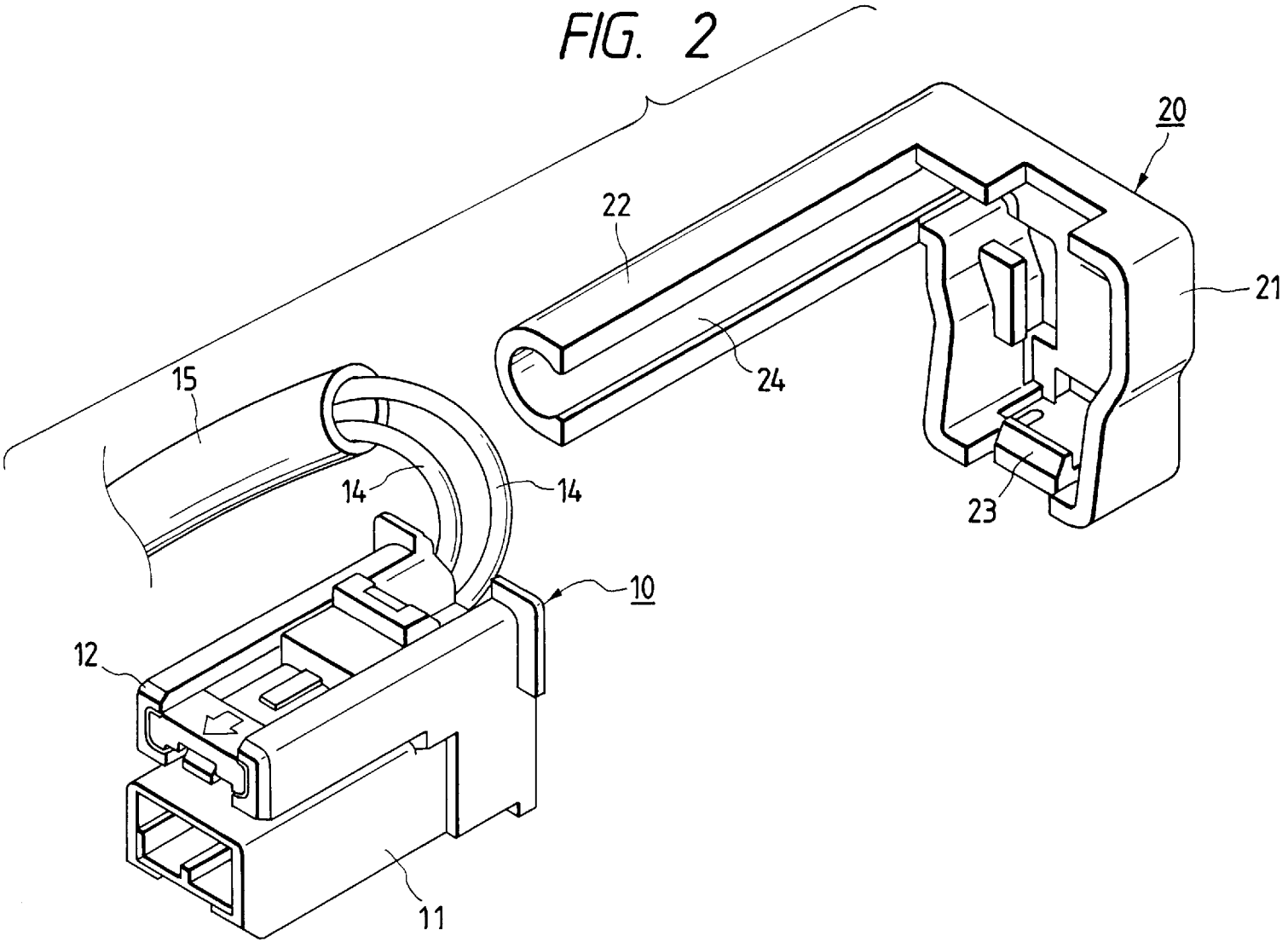
FIG. 2 is an exploded perspective view of the connector housing shown in FIG. 1.
Figure 3:
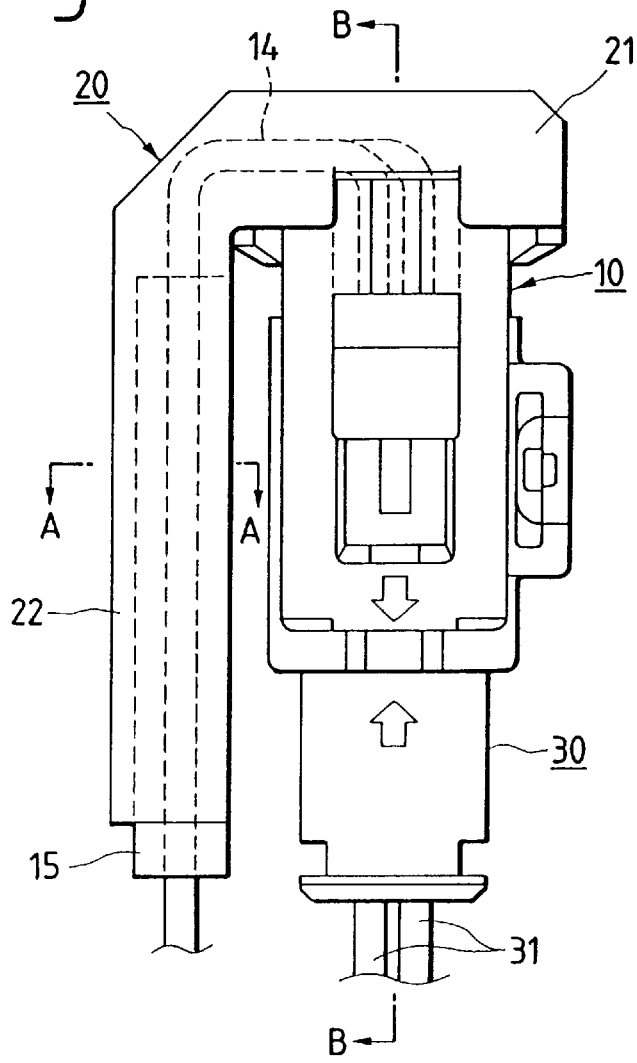
FIG. 3 is an overall side elevational view illustrating a state in which a mating connector housing is fitted to the connector housing shown in FIG. 1.
Figure 4:
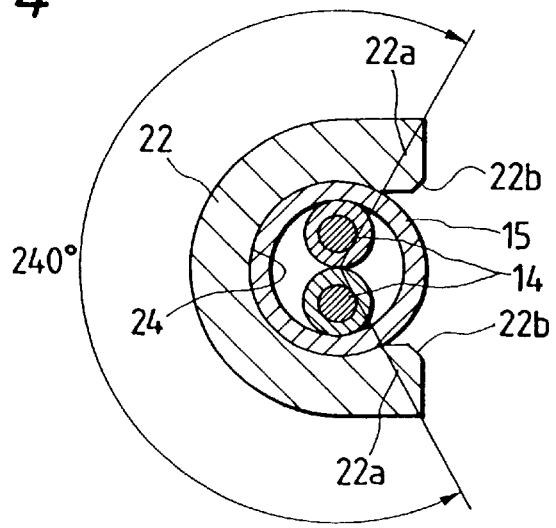
FIG. 4 is a section view taken along an arrow A shown in FIG. 3.
Figure 5:
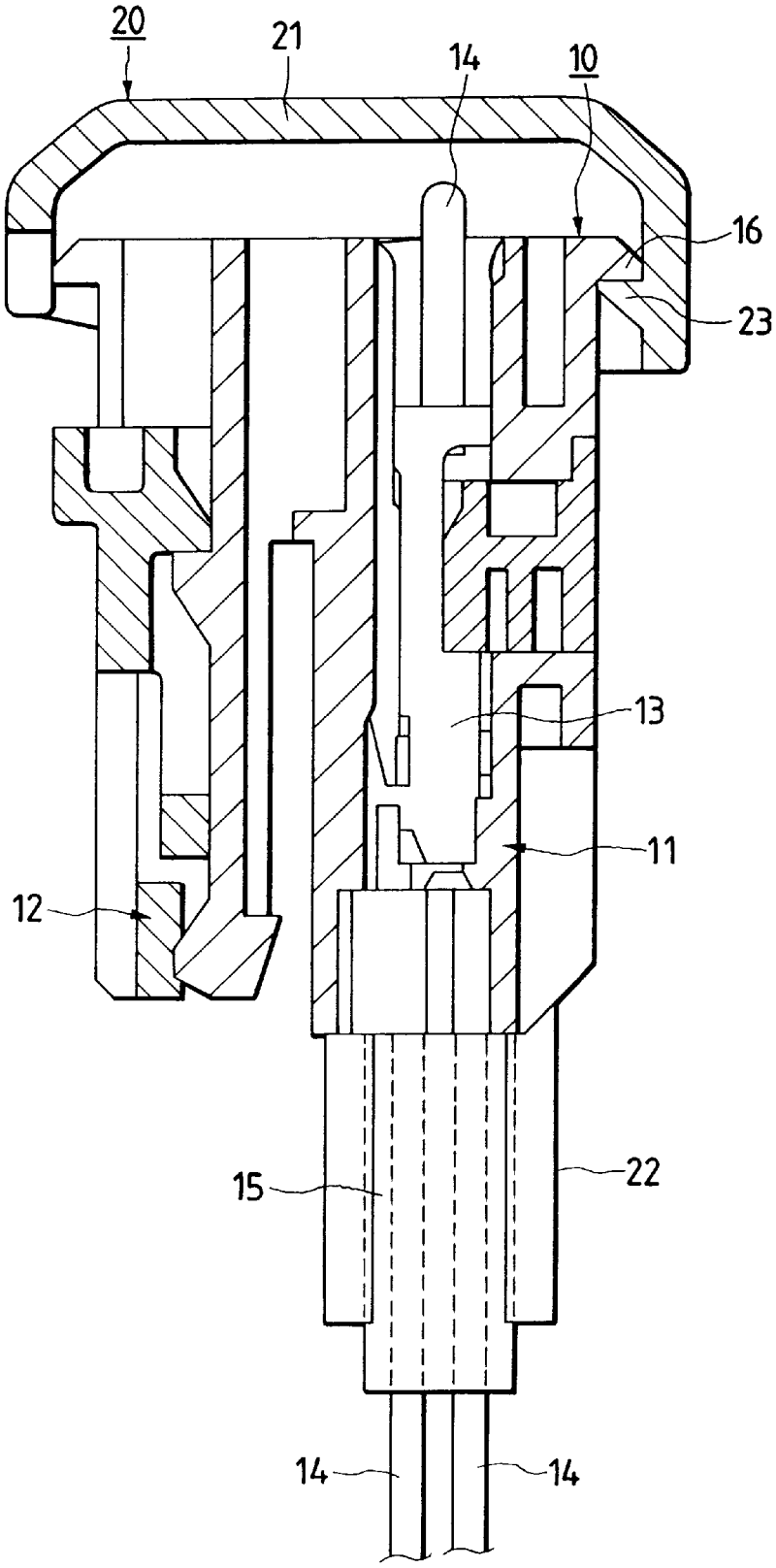
FIG. 5 is a section view taken along an arrow B shown in FIG. 3.

FIG. 1 is an overall perspective view of the connector housing in which the wire holding structure for a connector housing in accordance with the first aspect of the present invention is adopted. FIG. 2 is an exploded perspective view of a female connector housing shown in FIG. 1. FIG. 3 is an overall side elevational view illustrating a state in which a mating connector housing is fitted to the connector housing shown in FIG. 1. FIG. 4 is a section view taken along the arrow A shown in FIG. 3. FIG. 5 is a section view taken along the arrow B shown in FIG. 3.

As shown in FIGS. 1 to 5, the connector housing in this embodiment has a female connector housing 10 and a rear cover 20.

The female connector 10 injection molded of an insulating hard resin material has a connector body 11 which is fitted to a mating male connector housing 30 and a retaining portion 12 for fixing the male connector housing 30 in a fitted state and preventing it from coming off. In addition, one ends of a pair of wires 14 are respectively connected to a pair of connecting terminals 13 accommodated in the connector body 11.

Further, after the wires 14 are led out from a rear end portion of the female connector housing 10, the wires 14 are inserted in a protective tube 15 formed of a soft material such as vinyl. Incidentally, the protective tube 15 generally has a length sufficient to cover a range from the connector to an accessory device (a load, a control unit, a switch, or the like), but the protective tube 15 may be set to a desired length if it covers at least the portion corresponding to a wire holding portion 22 which will be described later.

Meanwhile, the rear cover 20 for protecting the wires 14 led out from the rear end portion of the female connector housing 10 together with the aforementioned protective tube 15 forms a wire holding member provided in the female connector housing 10 so as to restrict the leading-out direction of the wires 14 and cover and protect the wires 14. Incidentally, the rear cover 20 is injection molded of an insulating hard resin material.

As shown in FIG. 2, the rear cover 20 has a rear cover body 21 in the form of a cylinder with a bottom which fits over a rear end portion of the female connector housing 10, as well as a wire holding portion 22 having a groove portion 24 having a substantially U-shaped cross-section extending in a desired leading-out direction of the wires 14. Further, a flexible retaining piece 23 for securing the rear cover 20 to the rear end portion of the female connector housing 10 by engaging with an engaging portion 16 provided projectingly on a rear end portion of the connector body 11 is formed in a lower portion of the rear cover body 21 (see FIG. 5).

Incidentally, although the wire holding portion 22 in this embodiment is so structured that the leading-out direction of the wires 14 is restricted in such a manner as to face the front end side of the female connector housing 10, it goes without saying that the extending direction of the wire holding portion 22 is changed, as required, in correspondence with the desired leading-out direction.

As shown in FIG. 4, the groove portion 24 of the wire holding portion 22 has such a section shape as to be able to cover an outer periphery of the fitted cylindrical protective tube 15 circumferentially over an angular range of about 240°, and catches 22*a* are formed at both edges of opening thereof. Therefore, the protective tube 15 held in the groove portion 24 does not easily come off the opening. Incidentally, although in this embodiment the groove portion 24 covers the outer peripheral surface of the protective tube 15 circumferentially over about 240°, the present invention is not limited to the same, and it suffices if the protective tube 15 can be press fitted, and can be held and fixed. Namely, the groove portion 24 of the wire holding portion 22 is preferably formed in such a section shape as to cover the outer periphery of the protective tube 15 circumferentially over an angular range of more than 180° and less than 300°, so that the protective tube 15 can be easily fitted into the groove portion 24 and can be made difficult to come off.

Accordingly, after the wires 14 led out from the rear end portion of the female connector housing 10 are first folded back in such a manner as to extend toward the front side of the female connector housing 10, the rear cover 20 is fitted to the rear end portion of the female connector housing 10 in such a way that the protective tube 15 covering and protecting the wires 14 extends along the opening of the groove portion 24.

Then, the protective tube 15 is fitted into the groove portion 24 of the wire holding portion 22 from the lateral side of the groove, and is thereby press fitted and held therein. At this time, while the wire holding portion 22 is formed of a hard resin material, the protective tube 15 is formed of a soft vinyl material and is capable of easily undergoing elastic deformation, so that the protective tube 15 is easily press fitted into the groove portion 24 of the wire holding portion 22 despite the fact that the outside diameter of the protective tube 15 is larger than the opening width of the groove portion 24. In addition, guide tapers 22*b* for allowing the protective tube 15 to be fitted in more easily are respectively formed at opening edges of the groove portion 24.

Accordingly, since the protective tube 15 fitted in the groove portion 24 of the wire holding portion 22 is prevented from coming off by the pair of catches 22*a* formed at both edges of the opening and its own elastic restoring force, the protective tube 15 fitted in the groove portion 24 does not easily come off the opening. In addition, since the protective tube 15 does not come off in the axial direction by the frictional resistance occurring between its outer peripheral surface and the inner peripheral surface of the groove portion 24, the protective tube 15 is reliably held and fixed in the groove portion 24 of the wire holding portion 22.

Accordingly, the wires 14 led out from the rear end portion of the female connector housing 10 with the rear cover 20 attached thereto are reliably prevented from becoming entangled or damaged during transport and storage thanks to the wire holding member constituted by the protective tube 15 and the wire holding portion 22.

Further, as shown in FIGS. 3 and 5, if the male connector housing 30 is fitted to the female connector housing 10, the unillustrated connecting terminal accommodated in the male connector housing 30 and the connecting terminal 13 in the female connector housing 10 are connected to each other, and wires 31 on the male connector housing 30 side and the wires 14 on the female connector housing 10 side are electrically connected to each other. At this time, the wires 14 on the female connector housing 10 side are held in such a manner as to extend along the side faces of the female connector housing 10 and the male connector housing 30 in the state in which their leading-out direction is restricted, and the wires 14 are reliably protected from a tensile force or heat at the time of their use.

Namely, in accordance with the wire holding structure for the female connector housing 10 in this embodiment, since the wires 14 are held through the protective tube 15 press fitted and held in the wire holding portion 22 of the rear cover 20 constituting the wire protecting means, it is sufficient to merely press fit the protective tube 15 into the groove portion 24 of the wire holding portion 22, and it is unnecessary to hold the wires 14 by providing troublesome tape winding using adhesive tape. Accordingly, the operating efficiency in assembling improves substantially. It should be noted that it goes without saying that the adhesive tape or the like may be wound around the wire holding portion 22 in which the protective tube 15 has been press fitted in the groove portion 24, so as to hold and fix the wires 14 more reliably.

In addition, as for the wire holding portion 22 of the above-described wire holding member, it suffices if the wire holding portion 22 is only provided with the groove portion 24 having a substantially U-shaped cross section and extending along the leading-out direction of the wires 14, so that its shape does not become complex. Hence, as for the rear cover 20 in which the above-described wire holding portion 22 is formed, it is possible to prevent a situation in which a mold becomes complex and the manufacturing cost rises.

It should be noted that the present invention is not limited to the wire holding structure for the connector housing in the above-described embodiment, and it goes without saying that various modifications are possible.

Figure 6:
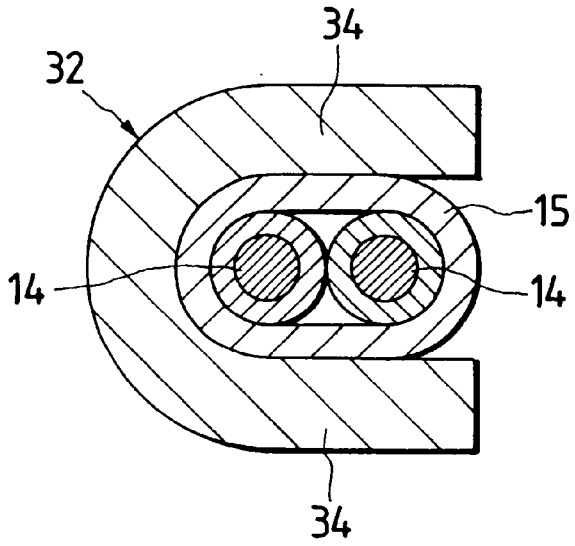
FIG. 6 is a an enlarged sectional view of an essential portion illustrating one modification of the connector housing shown in FIG. 1.

For example, an arrangement may be alternatively provided such that, as shown in FIG. 6, a groove portion 34 of a wire holding portion 32 is formed with a U-shaped cross section of a width narrower than the outside diameter of the protective tube 15, and the protective tube 15 press fitted in the groove portion 34 is crushed and is pressed and held by the inner wall of the groove.

Figure 7:
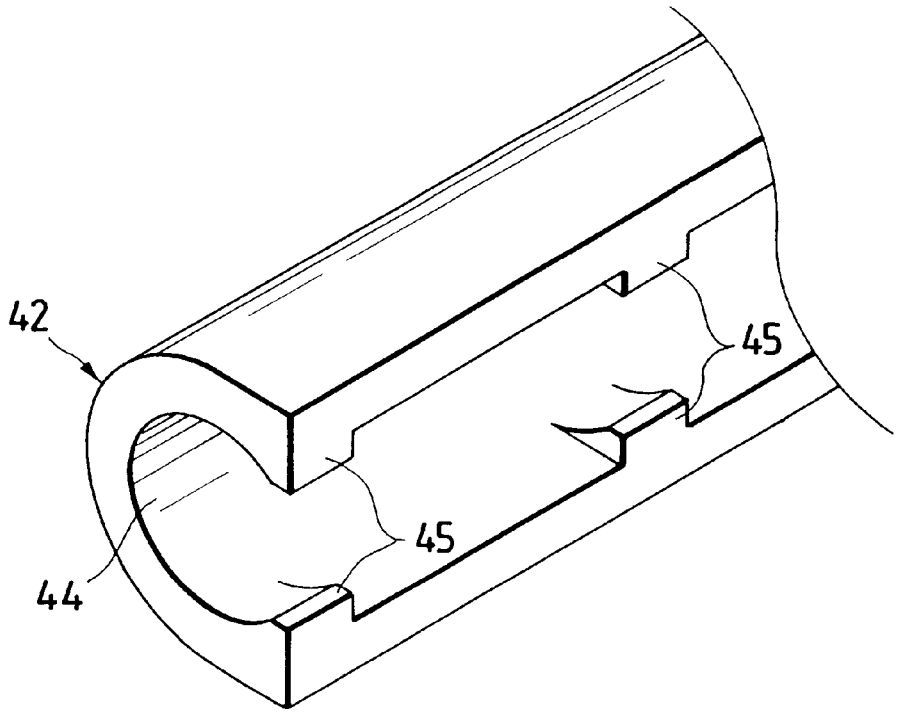
FIG. 7 is an enlarged perspective view of an essential portion illustrating another modification of the connector housing shown in FIG. 1.

Further, as shown in FIG. 7, a groove portion 44 of a wire holding portion 42 in the rear cover may be formed with a U-shaped cross section of a width substantially equal to the outside diameter of the protective tube 15, and a plurality of engaging projections 45 may be provided projectingly at both edges of the opening in the groove portion 44 to as to prevent the protective tube 15 from coming off by these engaging projections 45. Incidentally, although the engaging projections 45 which are respectively provided projectingly at both edges are arranged in such a manner as to oppose each other, the present invention is not limited to the same, and these engaging projections 45 may be arranged in such a manner as to oppose each other alternatively.

In addition, although in the above-described embodiment the wire holding portion having the groove portion is formed integrally with the rear cover for protecting the wires led out from the rear end portion of the housing, the present invention is not limited to the same, and the wire holding portion having the groove portion may be provided integrally with the connector housing. Further, the wire holding portion having the groove portion may be formed integrally with the rear holder which is detachably attached to the rear end of the housing so as to prevent the connecting terminal accommodated in the housing from coming off in the rearward direction. Furthermore, an arrangement may be alternatively provided such that a wire holding member in which the wire holding portion having the groove portion is provided is formed separately from the connector housing, and the wire holding member is detachably attached to the housing.

Furthermore, although in the above-described embodiment the protective tube 15 is made of vinyl which is an elastically deformable soft material, and the rear cover 20 having the wire holding portion 22 is molded of a hard resin material, it suffices if at least one of the wire holding portion and the protective tube is formed to be elastically deformable.

Figure 8A:
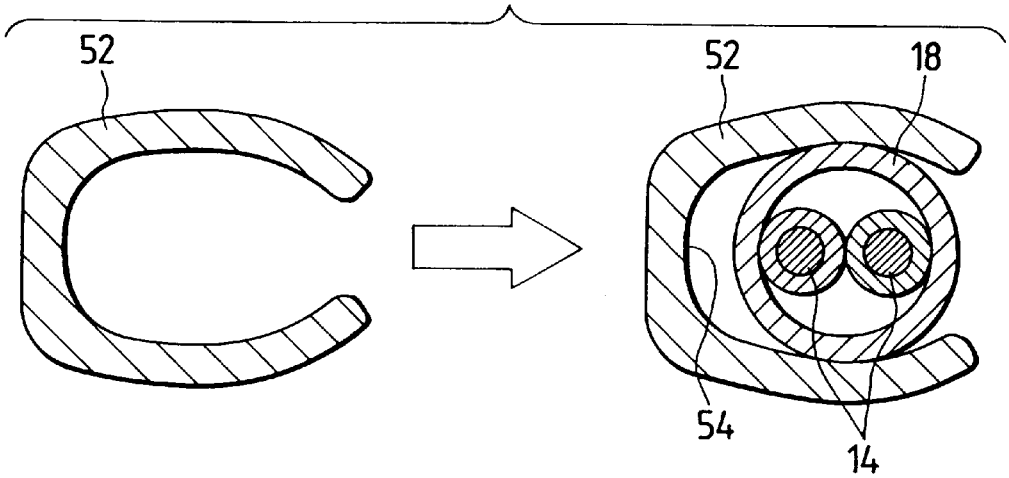
FIG. 8A is a sectional view of the partial assembly of a modification of the connector housing shown in FIG. 1.
Figure 9:
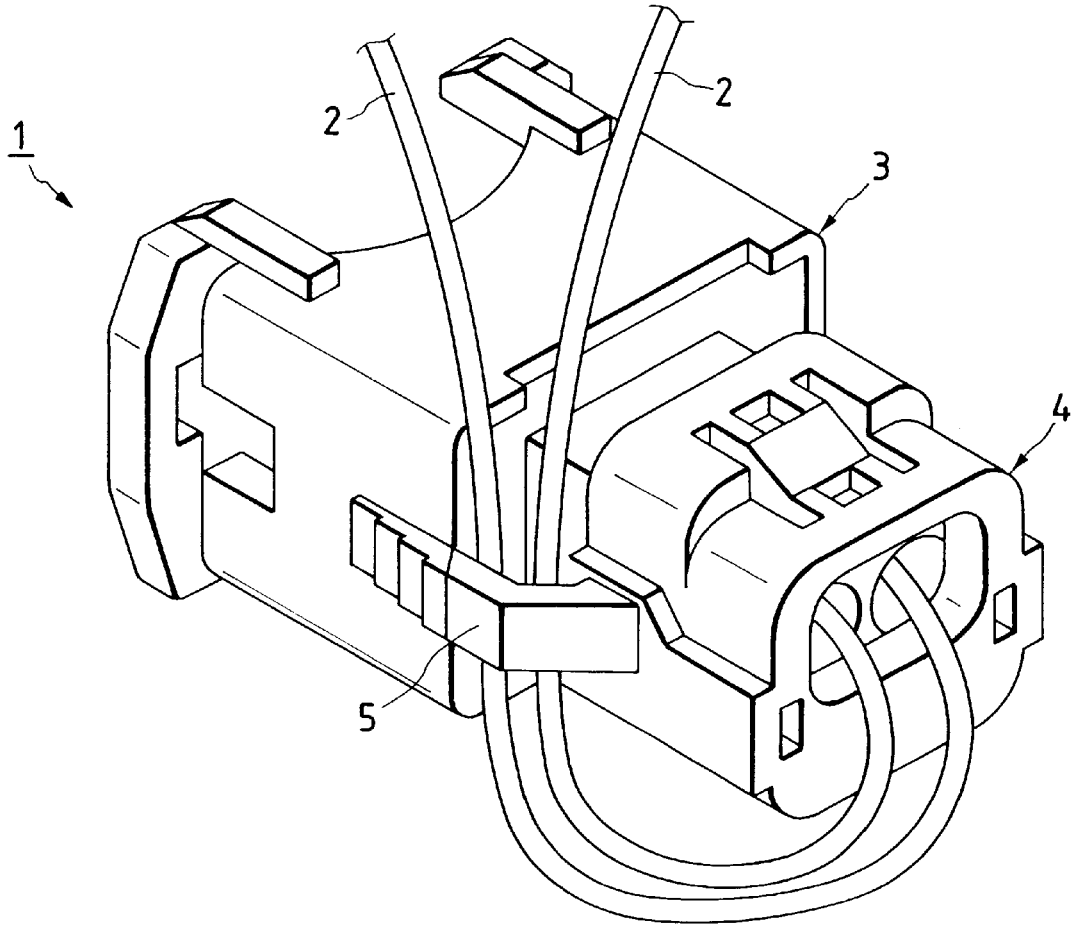
PRIOR ART FIG. 9
FIG. 9 is an overall perspective view of a connector housing for explaining a wire holding structure in a related connector housing.
Figure 8B:
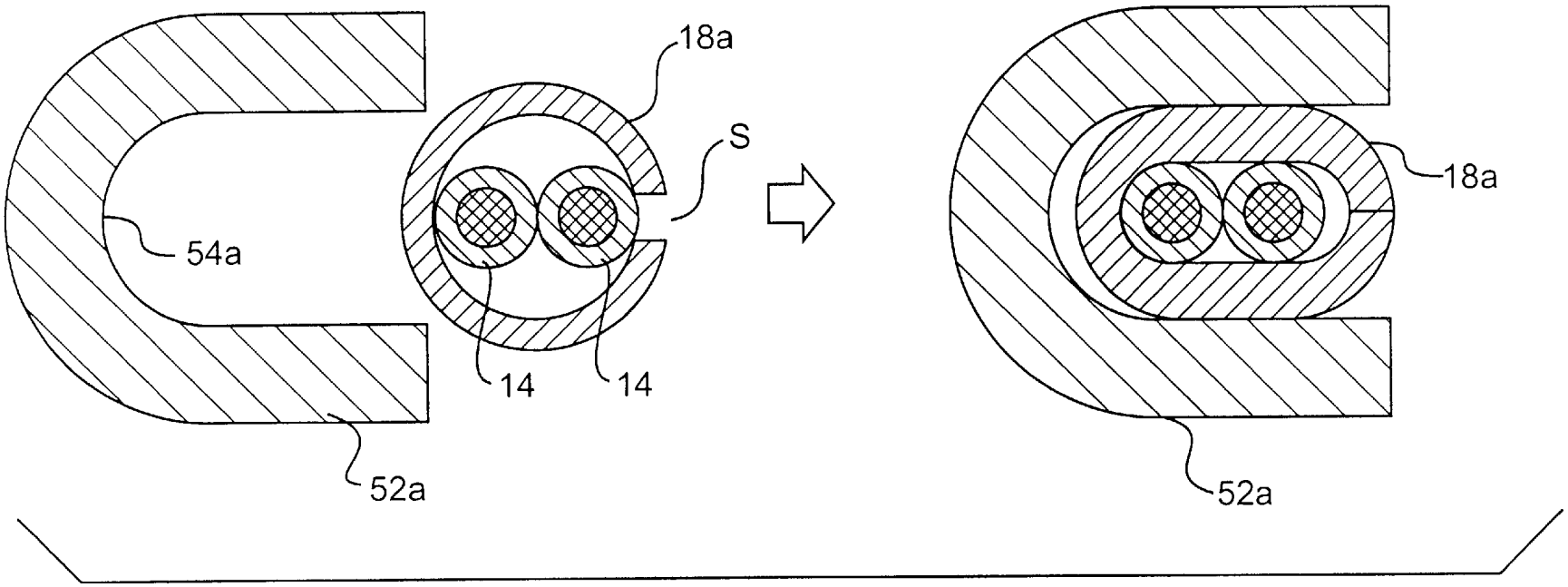
FIG. 8B is a sectional view of the partial assembly of another modification of the connector housing shown in FIG. 1.
Figure 10:
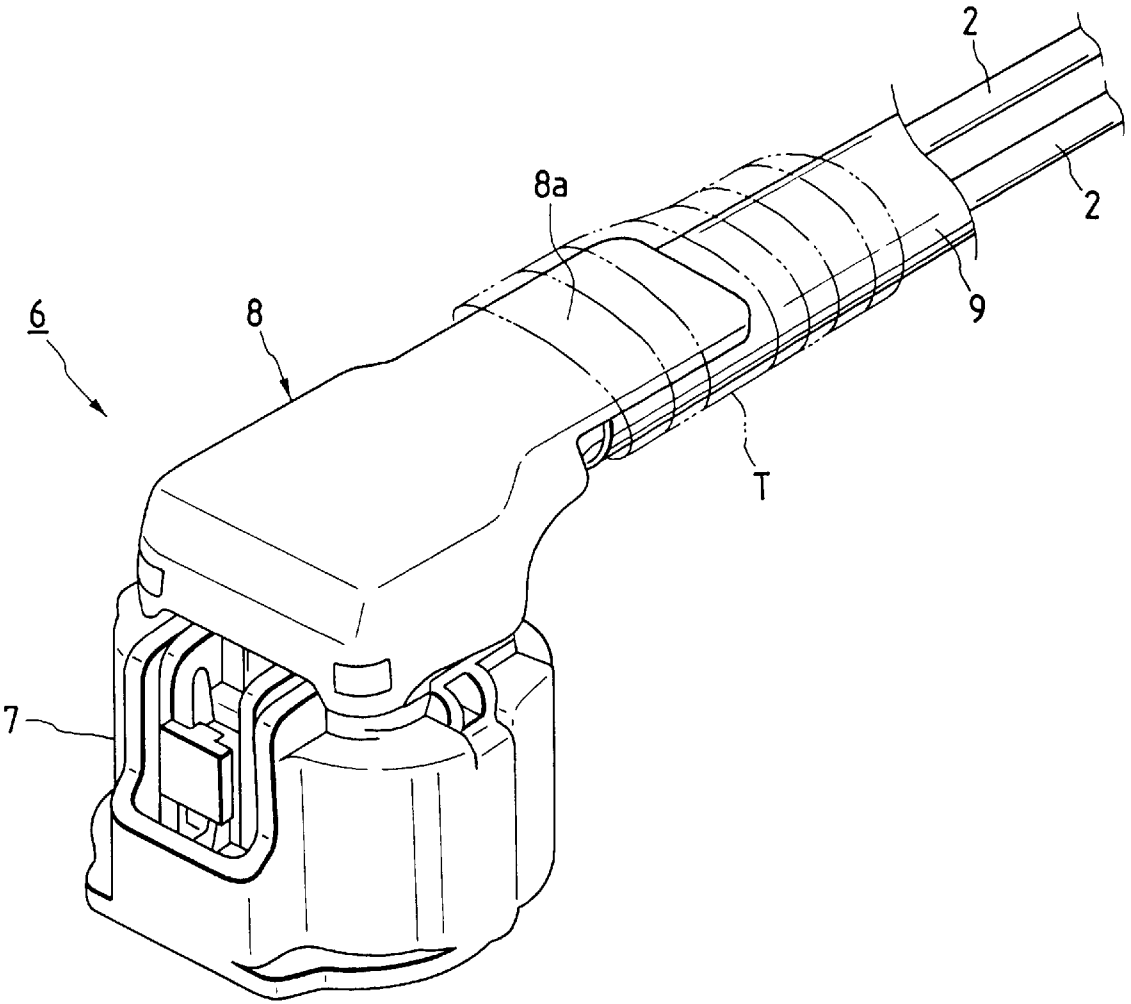
PRIOR ART FIG. 10
FIG. 10 is an overall perspective view of a connector housing for explaining a wire holding structure in another related connector housing.

Accordingly, the wire holding portion having a groove portion such as the one described above may be formed in the rear cover molded of a soft resin material which is elastically deformable, and the protective tube may be molded of a hard resin material. In this case, as shown in FIG. 8, a wire holding portion 52 formed in the rear cover is able to hold and fix a protective tube 18 since the wire holding portion 52 is elastically deformed in the direction in which the width of a groove portion 54 widens when the protective tube 18 is press fitted into the groove portion 54.

In addition, an arrangement may be alternatively provided such that the protective tube 18*a* is made elastically deformable in a diameter-reducing direction by providing a slits along the longitudinal direction of the protective tube molded of a hard resin material, and the protective tube is held and fixed in a groove portion 54*a* of wire holding portion 52*a* with a U-shaped cross section of a width narrower than the outside diameter of the protective tube 18*a*.

As has been described heretofore, according to the wire holding structure for a connector housing of the present invention, since the wires are held by the wire holding member through the protective tube press fitted and held in the wire holding portion, it is sufficient to merely press fit the protective tube into the groove portion of the wire holding portion, and there is no need to hold the wires by the troublesome tape winding.

In addition, the wire holding portion of the wire holding member suffices if it is provided with the groove portion extending along the leading-out direction of the wires, so that its shape does not become complex.

Therefore, it is possible to provide an inexpensive wire holding structure for a connector housing which makes it possible to reliably protect the electric wires led out from the connector housing by a simple attaching operation.

What is claimed is:

1. A wire holding structure for a connector housing comprising:

an electric wire one end of which is connected to a connection terminal accommodated within the connector housing, and led out from a rear end portion of the connector housing;

a wire holding portion extending from the connector housing along in a direction of which the electric wire is led out from the connector housing;

a groove portion formed on the wire holding portion along the direction which the wire holding portion extends from the connector housing and having a substantially U-shaped cross-section;

a protection tube fitted around a portion of the electric wire led out from the rear end portion of the connector housing and the protection tube being fitted into the groove portion formed on the wire holding portion; and a rear cover detachably provided on the rear portion of the connector housing for protecting the led-out electric wire, wherein the wire holding portion is formed integrally with the rear cover.

2. The wire holding structure of the connector housing as set forth in claim 1, wherein the the groove portion is formed in such a sectional shape as to cover an outer periphery of the protective tube circumferentially over an angular range of more than 180° and less than 300°.

3. The wire holding structure of the connector housing as set forth in claim 1, wherein at least one of the wire holding portion and the protection tube is formed so as to be able to deform elastically.

4. The wire holding structure of the connector housing as set forth in claim 3, wherein the wire holding portion is made of a hard material and the protection tube is made of a soft material.

5. The wire holding structure of the connector housing as set forth in claim 4, wherein a width of the groove portion is less than a diameter of the protection tube.

6. The wire holding structure of the connector housing as set forth in claim 4, wherein a width of the groove portion is substantially equal to a diameter of the protection tube.

7. The wire holding structure of the connector housing as set forth in claim 6, wherein edge portions of the groove portion are tapered.

8. The wire holding structure of the connector housing as set forth in claim 6, wherein projections are formed on edge portions of the groove portion.

9. The wire holding structure of the connector housing as set forth in claim 3, wherein the protection tube is made of a hard material and the wire holding portion is made of a soft material.

10. The wire holding structure of the connector housing as set forth in claim 9, wherein a slit is formed on the protection tube along a longitudinal direction thereof.

11. A wire holding structure for a connector housing comprising:

an electric wire one end of which is connected to a connection terminal accommodated within the connector housing, and led out from a rear end portion of the connector housing;

a wire holding portion extending from the connector housing along in a direction of which the electric wire is led out from the connector housing;

a groove portion formed on the wire holding portion along the direction which the wire holding portion extends from the connector housing and having a substantially U-shaped cross-section;

a protection tube fitted around a portion of the electric wire led out from the rear end portion of the connector housing and the protection tube being fitted into the groove portion formed on the wire holding portion; and a rear holder detachably provided on the rear portion of the connector housing for preventing the terminal from removing from the connector housing, wherein the wire holding portion is formed integrally with the rear holder.

* * * * *